US008282346B2

(12) United States Patent
Deodhar et al.

(10) Patent No.: US 8,282,346 B2
(45) Date of Patent: Oct. 9, 2012

(54) METHODS, SYSTEMS AND/OR APPARATUS RELATING TO SEALS FOR TURBINE ENGINES

(75) Inventors: Subodh D. Deodhar, Bangalore (IN); Gary M. Itzel, Simpsonville, SC (US); Nagendra Karthik Depuru Mohan, Andhra Pradesh (IN)

(73) Assignee: General Electric Company, Schenectady, NY (US)

( * ) Notice: Subject to any disclaimer, the term of this patent is extended or adjusted under 35 U.S.C. 154(b) by 749 days.

(21) Appl. No.: 12/418,798

(22) Filed: Apr. 6, 2009

(65) Prior Publication Data

US 2010/0254806 A1 Oct. 7, 2010

(51) Int. Cl.
*F01D 11/12* (2006.01)

(52) U.S. Cl. ..... 415/174.5; 415/173.7

(58) Field of Classification Search ..... 415/191, 415/174.5, 173.3, 173.4, 116, 173.7; 277/411, 277/412, 415; 416/193 A
See application file for complete search history.

(56) References Cited

U.S. PATENT DOCUMENTS 3,262,635 A * 7/1966 Smuland ..... 417/355
4,177,004 A 12/1979 Riedmiller et al.
4,309,145 A * 1/1982 Viola ..... 415/173.7
4,767,267 A 8/1988 Salt et al.
5,358,374 A * 10/1994 Correia et al. ..... 415/47
5,785,492 A * 7/1998 Belsom et al. ..... 415/173.7
6,116,612 A 9/2000 Halliwell et al.
6,962,342 B2 11/2005 Wieghardt
7,334,983 B2 2/2008 Alvanos et al.
2009/0208326 A1* 8/2009 Durocher et al. ..... 415/134

* cited by examiner

*Primary Examiner* — Caridad Everhart
(74) *Attorney, Agent, or Firm* — Mark E. Henderson; Ernest G. Cusick; Frank A. Landgraff

(57) ABSTRACT

A seal formed between at least two blades in the turbine of a turbine engine, a first turbine blade and a second turbine blade, wherein one of the turbine blades comprises a turbine rotor blade and the other turbine blade comprises a turbine stator blade, and wherein a trench cavity and the seal is formed between the first turbine blade and the second turbine blade when first turbine blade is circumferentially aligned with the second turbine blade, the seal comprising: a cutter tooth and a honeycomb; wherein: the cutter tooth comprises an axially extending rigid tooth that is positioned on one of the first turbine blade and the second turbine blade and the honeycomb comprises an abradable material that is positioned on the other of the first turbine blade and the second turbine blade; and the cutter tooth and the honeycomb are positioned such that each opposes the other across the trench cavity when the first turbine blade is circumferentially aligned with the second turbine blade.

19 Claims, 6 Drawing Sheets

METHODS, SYSTEMS AND/OR APPARATUS RELATING TO SEALS FOR TURBINE ENGINES

BACKGROUND OF THE INVENTION

The present application relates generally to methods, systems, and/or apparatus for improving the efficiency and/or operation of turbine engines, which, as used herein and unless specifically stated otherwise, is meant to include all types of turbine or rotary engines, including gas turbine engines, aircraft engines, steam turbine engines, and others. More specifically, but not by way of limitations the present application relates to methods, systems, and/or apparatus pertaining to improved seals for turbine engines.

In general, a gas turbine engine (which, as discussed below, may be used to illustrate an exemplary application of the current invention) includes a compressor, a combustor, and a turbine. The compressor and turbine generally include rows of blades that are axially or circumferentially stacked in stages. Each stage includes a row of circumferentially-spaced stator blades, which are fixed, and a row of rotor blades, which rotate about a central axis or shaft. In operation, generally, the compressor rotor blades rotate about the shaft, and, acting in concert with the stator blades, compress a flow of air. The supply of compressed air then is used in the combustor to combust a supply of fuel. Then, the resulting flow of hot expanding gases from the combustion, i.e., the working fluid, is expanded through the turbine section of the engine. The flow of working fluid through the turbine induces the rotor blades to rotate. The rotor blades are connected to a central shaft such that the rotation of the rotor blades rotates the shaft. In this manner, the energy contained in the fuel is converted into the mechanical energy of the rotating shaft, which, for example, may be used to rotate the rotor blades of the compressor, such that the supply of compressed air needed for combustion is produced, and the coils of a generator, such that electrical power is generated.

During operation, because of the extreme temperatures of the hot-gas path, great care is taken to prevent components from reaching temperatures that would damage or degrade their operation or performance. As one of ordinary skill in the art will appreciate, one area that is sensitive to extreme temperatures is the space that is radially inward of the hot-gas path. This area, which is often referred to as the inner wheelspace or wheelspace of the turbine, contains the several turbine wheels or rotors onto which the rotating rotor blades are attached. While the rotor blades are designed to withstand the extreme temperatures of the hot-gas path, the rotors are not and, thus, it is necessary that the working fluid of the hot-gas path be prevented from flowing into the wheelspace. However, axial gaps necessarily exist between the rotating blades and the surrounding stationary parts and it is through these gaps that working fluid gains access to the wheelspace. In addition, because of the way the engine warms up and differing thermal expansion coefficients, these gaps may widen and shrink depending on the way the engine is being operated. This variability in size makes it difficult to adequately seal these gaps.

Generally, this means that the turbine wheelspace must be purged to avoid hot gas ingestion. Purging requires that the pressure within the wheelspace be maintained at a level that is greater than the pressure of the working fluid. Typically, this is achieved by bleeding air from the compressor and routing it directly into the wheelspace. When this is done an out-flow of purge air is created (i.e., a flow of purge air from the wheelspace to the hot-gas path), and this out-flow through the gaps prevents the in-flow of working fluid. Thereby, the components within the wheelspace are protected from the extreme temperatures of the working fluid.

However, purging systems increase the manufacturing and maintenance cost of the engine, and are often inaccurate in terms of maintain a desired level of pressure in the wheelspace cavity. In addition, purging the wheelspace comes at a price. As one of ordinary skill in the art will appreciate, purge flows adversely affect the performance and efficiency of the turbine engine. That is, increased levels of purge air reduce the output and efficiency of the engine. Hence, the usage of purge air should be minimized. As a result, there is a need for improved methods, systems and/or apparatus that better seal the gaps/wheelspace cavity from the working fluid, thereby reducing wheelspace ingestion and/or the usage of purge air.

BRIEF DESCRIPTION OF THE INVENTION

The present application thus describes a seal formed between at least two blades in the turbine of a turbine engine, a first turbine blade and a second turbine blade, wherein one of the turbine blades comprises a turbine rotor blade and the other turbine blade comprises a turbine stator blade, and wherein a trench cavity and the seal is formed between the first turbine blade and the second turbine blade when first turbine blade is circumferentially aligned with the second turbine blade, the seal comprising: a cutter tooth and a honeycomb; wherein: the cutter tooth comprises an axially extending rigid tooth that is positioned on one of the first turbine blade and the second turbine blade and the honeycomb comprises an abradable material that is positioned on the other of the first turbine blade and the second turbine blade; and the cutter tooth and the honeycomb are positioned such that each opposes the other across the trench cavity when the first turbine blade is circumferentially aligned with the second turbine blade.

These and other features of the present application will become apparent upon review of the following detailed description of the preferred embodiments when taken in conjunction with the drawings and the appended claims.

BRIEF DESCRIPTION OF THE DRAWINGS

These and other features of this invention will be more completely understood and appreciated by careful study of the following more detailed description of exemplary embodiments of the invention taken in conjunction with the accompanying drawings, in which.

DETAILED DESCRIPTION OF THE INVENTION

Figure 1:
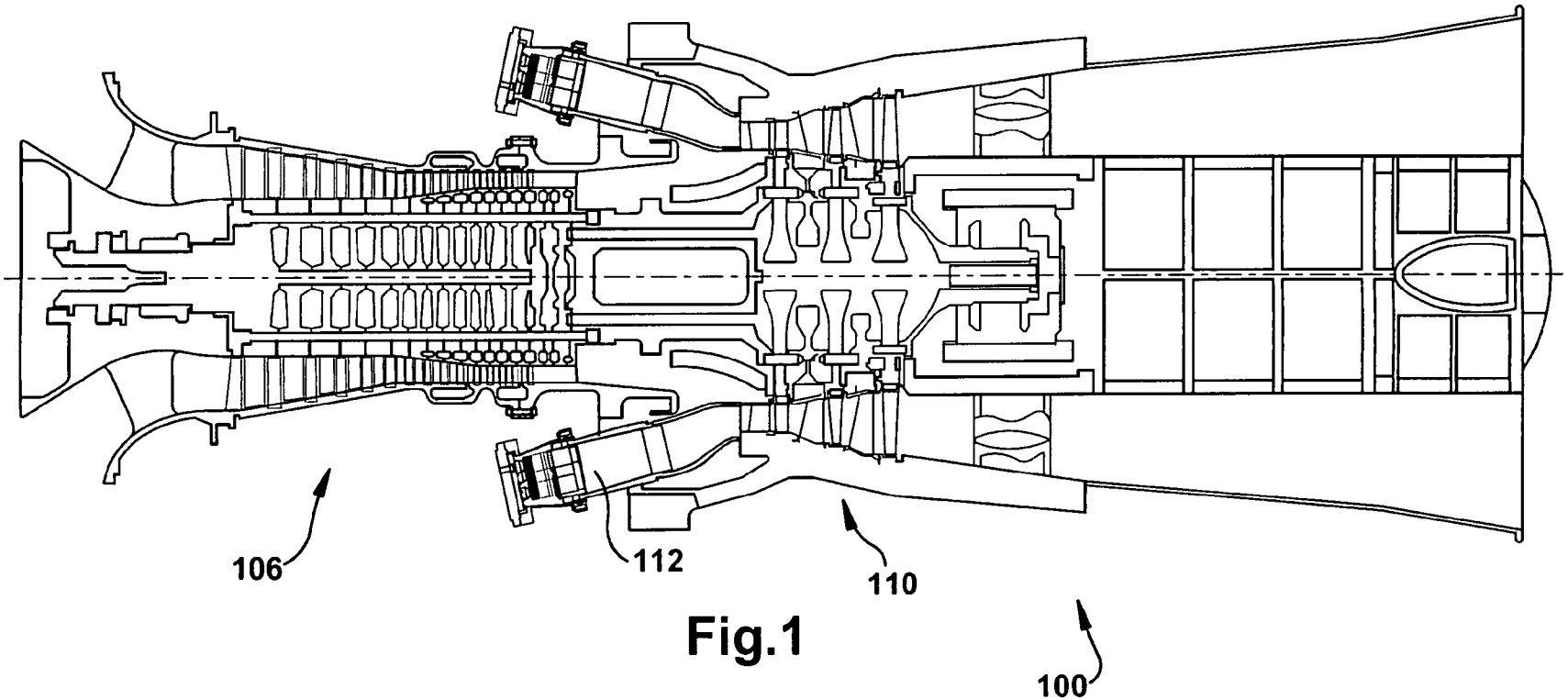
FIG. 1 is a schematic representation of an exemplary gas turbine engine in which embodiments of the present application may be used.

Referring now to the figures, FIG. 1 illustrates a schematic representation of a gas turbine engine 100, which will be used to describe an exemplary application of the present invention. It will be understood by those skill in the art that the present invention is not limited to this type of usage. As stated, the present invention may be used in gas turbine engines, such as the engines used in power generation and airplanes, steam turbine endings, and other type of rotary engines. In general, gas turbine engines operate by extracting energy from a pressurized flow of hot gas that is produced by the combustion of a fuel in a stream of compressed air. As illustrated in FIG. 1, gas turbine engine 100 may be configured with an axial compressor 106 that is mechanically coupled by a common shaft or rotor to a downstream turbine section or turbine 110, and a combustor 112 positioned between the compressor 106 and the turbine 110.

Figure 2:
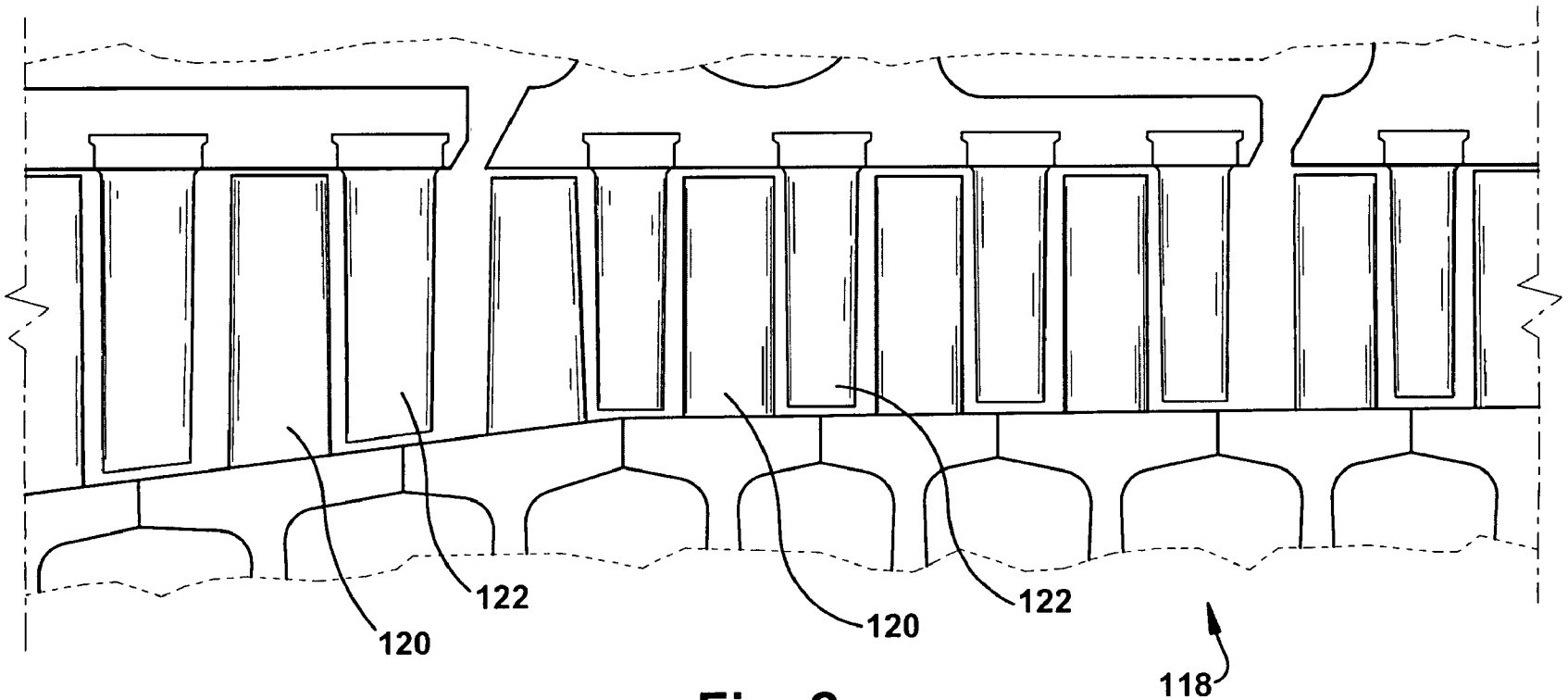
FIG. 2 is a sectional view of the compressor in the gas turbine engine of FIG. 1.

FIG. 2 illustrates a view of an exemplary multi-staged axial compressor 118 that may be used in the gas turbine engine of FIG. 1. As shown, the compressor 118 may include a plurality of stages. Each stage may include a row of compressor rotor blades 120 followed by a row of compressor stator blades 122. Thus, a first stage may include a row of compressor rotor blades 120, which rotate about a central shaft, followed by a row of compressor stator blades 122, which remain stationary during operation. The compressor stator blades 122 generally are circumferentially spaced one from the other and fixed about the axis of rotation. The compressor rotor blades 120 are circumferentially spaced and attached to the shaft; when the shaft rotates during operation, the compressor rotor blades 120 rotates about it. As one of ordinary skill in the art will appreciate, the compressor rotor blades 120 are configured such that, when spun about the shaft, they impart kinetic energy to the air or fluid flowing through the compressor 118. The compressor 118 may have other stages beyond the stages that are illustrated in FIG. 2. Additional stages may include a plurality of circumferential spaced compressor rotor blades 120 followed by a plurality of circumferentially spaced compressor stator blades 122.

Figure 3:
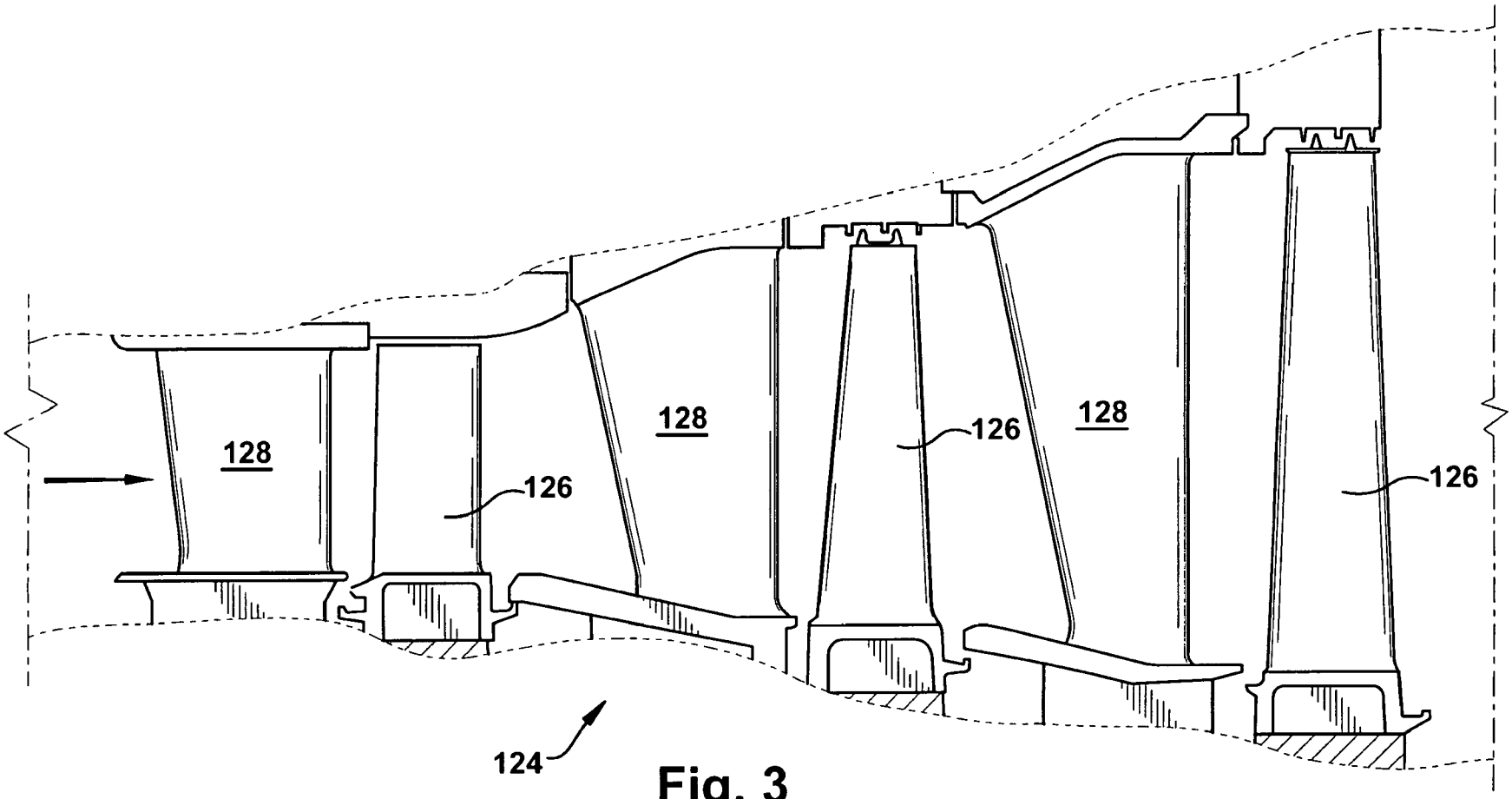
FIG. 3 is a sectional view of the turbine in the gas turbine engine of FIG. 1.

FIG. 3 illustrates a partial view of an exemplary turbine section or turbine 124 that may be used in the gas turbine engine of FIG. 1. The turbine 124 also may include a plurality of stages. Three exemplary stages are illustrated, but more or less stages may present in the turbine 124. A first stage includes a plurality of turbine buckets or turbine rotor blades 126, which rotate about the shaft during operation, and a plurality of nozzles or turbine stator blades 128, which remain stationary during operation. The turbine stator blades 128 generally are circumferentially spaced one from the other and fixed about the axis of rotation. The turbine rotor blades 126 may be mounted on a turbine wheel (not shown) for rotation about the shaft (not shown). A second stage of the turbine 124 also is illustrated. The second stage similarly includes a plurality of circumferentially spaced turbine stator blades 128 followed by a plurality of circumferentially spaced turbine rotor blades 126, which are also mounted on a turbine wheel for rotation. A third stage also is illustrated, and similarly includes a plurality of turbine stator blades 128 and rotor blades 126. It will be appreciated that the turbine stator blades 128 and turbine rotor blades 126 lie in the hot gas path of the turbine 124. The direction of flow of the hot gases through the hot gas path is indicated by the arrow. As one of ordinary skill in the art will appreciate, the turbine 124 may have other stages beyond the stages that are illustrated in FIG. 3. Each additional stage may include a row of turbine stator blades 128 followed by a row of turbine rotor blades 126.

In use, the rotation of compressor rotor blades 120 within the axial compressor 118 may compress a flow of air. In the combustor 112, energy may be released when the compressed air is mixed with a fuel and ignited. The resulting flow of hot gases from the combustor 112, which may be referred to as the working fluid, is then directed over the turbine rotor blades 126, the flow of working fluid inducing the rotation of the turbine rotor blades 126 about the shaft. Thereby, the energy of the flow of working fluid is transformed into the mechanical energy of the rotating blades and, because of the connection between the rotor blades and the shaft, the rotating shaft. The mechanical energy of the shaft may then be used to drive the rotation of the compressor rotor blades 120, such that the necessary supply of compressed air is produced, and also, for example, a generator to produce electricity.

Before proceeding further, note that in order to communicate clearly the invention of the current application, it may be necessary to select terminology that refers to and describes certain machine components or parts of a turbine engine. Whenever possible, terminology that is used in the industry will be selected and employed in a manner consistent with its accepted meaning. However, it is meant that this terminology be given a broad meaning and not narrowly construed such that the meaning intended herein and the scope of the appended claims is restricted. Those of ordinary skill in the art will appreciate that often certain components are referred to with several different names. In addition, what may be described herein as a single part may include and be referenced in another context as several component parts, or, what may be described herein as including multiple component parts may be fashioned into and, in some cases, referred to as a single part. As such, in understanding the scope of the invention described herein, attention should not only be paid to the terminology and description provided, but also to the structure, configuration, function, and/or usage of the component.

In addition, several descriptive terms may be used herein. The meaning for these terms shall include the following definitions. The term "rotor blade", without further specificity, is a reference to the rotating blades of either the compressor 118 or the turbine 124, which include both compressor rotor blades 120 and turbine rotor blades 126. The term "stator blade", without further specificity, is a reference the stationary blades of either the compressor 118 or the turbine 124, which include both compressor stator blades 122 and turbine stator blades 128. The term "blades" will be used herein to refer to either type of blade. Thus, without further specificity, the term "blades" is inclusive to all type of turbine engine blades, including compressor rotor blades 120, compressor stator blades 122, turbine rotor blades 126, and turbine stator blades 128. Further, as used herein, "downstream" and "upstream" are terms that indicate a direction relative to the flow of working fluid through the turbine. As such, the term "downstream" means the direction of the flow, and the term "upstream" means in the opposite direction of the flow through the turbine. Related to these terms, the terms "aft" and/or "trailing edge" refer to the downstream direction, the downstream end and/or in the direction of the downstream end of the component being described. And, the terms "forward" or "leading edge" refer to the upstream direction, the upstream end and/or in the direction of the upstream end of the component being described. The term "radial" refers to movement or position perpendicular to an axis. It is often required to describe parts that are at differing radial positions with regard to an axis. In this case, if a first component resides closer to the axis than a second component, it may be stated herein that the first component is "inboard" or "radially inward" of the second component. If, on the other hand, the first component resides further from the axis than the second component, it may be stated herein that the first component is "outboard" or "radially outward" of the second component.

The term "axial" refers to movement or position parallel to an axis. And, the term "circumferential" refers to movement or position around an axis.

Figure 4:
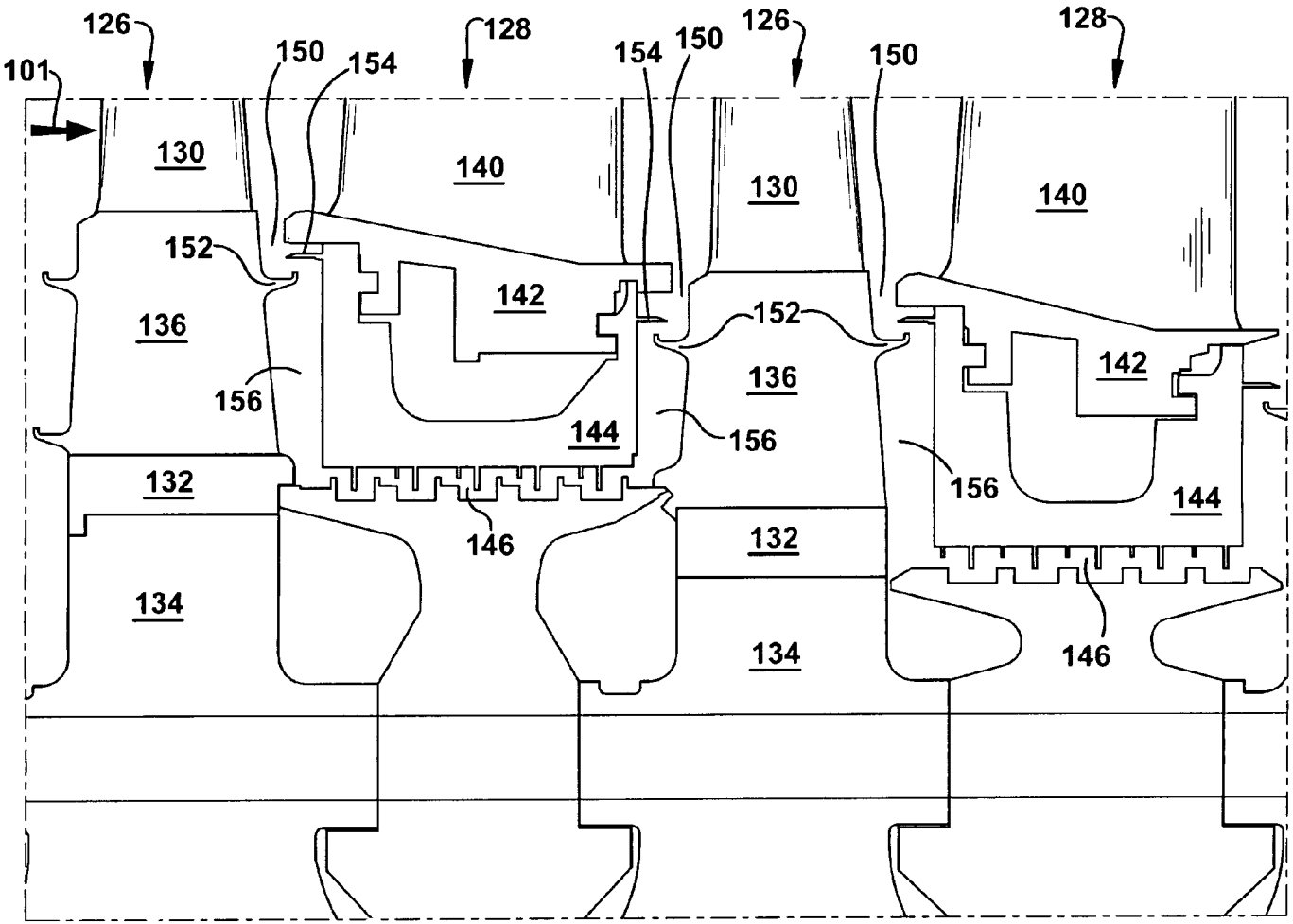
Fig. 4 (Prior Art)
FIG. 4 is a schematic sectional view of the inner radial portion of several rows of rotor and stator blades as configured in an exemplary turbine according to conventional design.

Referring again to the figures, FIG. 4 schematically illustrates a sectional view of the radially inward portion of several rows of blades as they might be configured in an exemplary turbine according to conventional design. As one of ordinary skill in the art will appreciate, the view includes the radial inward features of two rows of rotor blades 126 and two rows of stator blades 128. Each rotor blade 126 generally includes an airfoil 130 that resides in the hot-gas path and interacts with the working fluid of the turbine (the flow direction of which is indicated by arrow 131), a dovetail 132 that attaches the rotor blade 126 to a rotor wheel 134, and, between the airfoil 130 and the dovetail 132, a section that is typically referred to as the shank 136. As used herein, the shank 136 is meant to refer to the section of the rotor blade 126 that resides between the attachment means, which in this case is the dovetail 132, and the airfoil 130. Each stator blade 128 generally includes an airfoil 140 that resides in the hot-gas path and interacts with the working fluid and, radially inward of the airfoil 140, an inner sidewall 142 and, radially inward of the inner sidewall 142, a diaphragm 144. Typically, the inner sidewall 142 is integral to the airfoil 140 and forms the inner boundary of the hot-gas path. The diaphragm 144 typically attaches to the inner sidewall 142 (though may be formed integral therewith) and extends in an inward radial direction to form a seal 146 with the rotating machinery.

It will be appreciated that axial gaps are present along the radially inward edge of the hot-gas path. Generally, these gaps, which will be referred to herein as "trench cavities 150", are present because of the space that must be maintained between the rotating parts (i.e., the rotor blades 126) and the stationary parts (i.e., the stator blades 128). Because of the way the engine warms up, operates at different load conditions, and the differing thermal expansion coefficients of some of the components, the width of the trench cavity 150 (i.e., the axial distance across the gap) generally varies. That is, the trench cavity 150 may widen and shrink depending on the way the engine is being operated. Because it is highly undesirable for the rotating parts to rub against stationary parts, the engine must be designed such that at least some space is maintained at the trench cavity 150 locations during all operating conditions. This generally results in a trench cavity 150 that has a relatively narrow opening during some operating conditions and a relatively wide opening during other operating conditions. Of course, a trench cavity 150 with a relatively wide opening is undesirable because it invites more working fluid ingestion into the turbine wheelspace.

It will be appreciated that a trench cavity 150 generally exists at each point along the radially inward boundary of the hot-gas path where rotating parts border stationary parts. Thus, as illustrated, a trench cavity 150 is formed between the trailing edge of the rotor blade 126 and the leading edge of the stator blade 128 and between the trailing edge of the stator blade 128 and the leading edge of the rotor blade 126. Typically, in regard to the rotor blades 126, the shank 136 defines one edge of the trench cavity 150, and, in regard to the stator blades 128, the inner sidewall 142 defines the other edge of the trench cavity 150. Often, axial projecting projections may be configured within the trench cavity 150. As shown, angel wing projections or angel wings 152 may be formed on the shank 136 of the rotor blades 126. Each angel wing 152 may coincide with a stator projection 154 that is formed on the stator blade 128. The stator projection 154 may be formed on either the inner sidewall 142 or, as shown, on the diaphragm 144. Typically, the angel wing 152 is formed inboard of the stator projection 154, as shown. More than one angel wing 152/stator projection 154 pair may be present. Generally, inboard of the first angel wing 152, the trench cavity 150 is said to transition into a wheelspace cavity 156.

As stated, it is desirable to prevent the working fluid of the hot-gas path from entering the trench cavity 150 and the wheelspace cavity 156 because the extreme temperatures may damage the components within this area. The angel wing 152 and the stator projection 154 are formed to limit ingestion. However, because of the varying width of the trench cavity 150 opening and the relative ineffectiveness of the angel wing 152/stator projection 154, working fluid would be regularly ingested into the wheelspace cavity 156 if the cavity were not purged with a relatively high level of compressed air bled from the compressor. As stated, because purge air negatively affects the performance and efficiency of the engine, its usage should be minimized.

Figure 5:
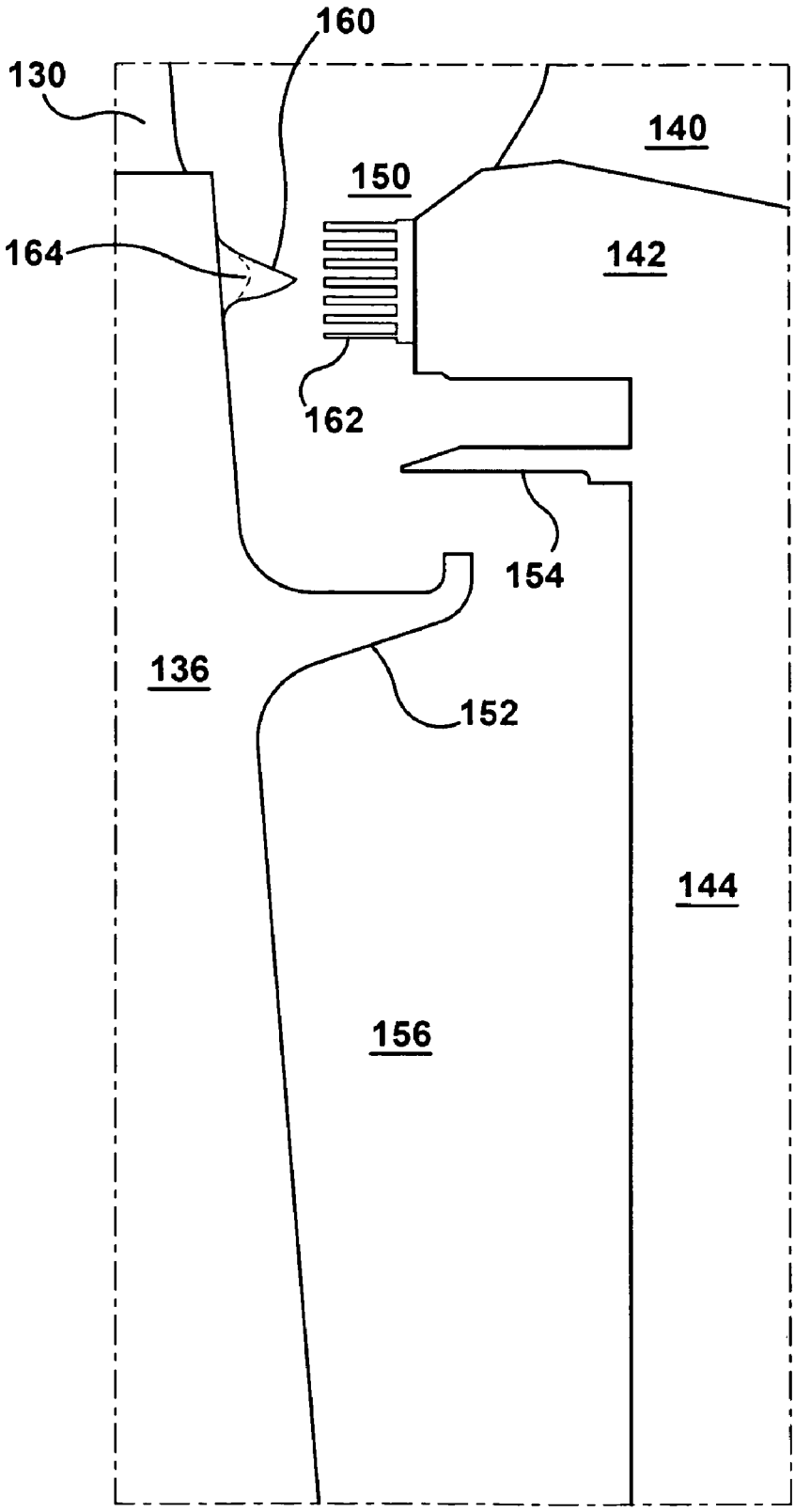
FIG. 5 is a sectional view of a trench cavity and a cutter tooth/honeycomb assembly according to an exemplary embodiment of the present invention.

FIG. 5 illustrates a section view of a cutter tooth 160/honeycomb 162 assembly according to an embodiment of the present application. In general, according to the present application, a cutter tooth 160/honeycomb 162 assembly includes an axial extending rigid tooth that opposes an abradable material across the trench cavity 150.

As shown, in some embodiments, the cutter tooth 160 may be formed on the trailing edge of the rotor blade 126. More particularly, the cutter tooth 160 may be formed on the trailing edge of the shank 136. The cutter tooth 160 generally comprises a rigid, axially extending protrusion and may be formed with any suitable material. As shown, the cutter tooth. 160 may be triangular in shape such that it forms a sharp edge, though other shapes are also possible. The cutter tooth 160 may extend along the circumferential width of the shank 136. In some preferred embodiments, the cutter tooth 160 may extend for a circumferential distance that is shorter than the circumferential width of the shank 136. In this case, the cutter tooth 160 may be positioned in the approximate center of the circumferential width of the shank 136. In this type of the embodiment, a tooth ridge 164 (indicated by the dashed line) may extend over the remainder of the circumferential width of the shank 136 and continue along the same longitudinal axis of the cutter tooth 160. The cutter tooth 160 and/or the tooth ridge 164 may extend along the approximate entire width of each shank 136 such that they form an approximate circle around the row of rotor blades 126, with the center of the circle being substantially aligned with the shaft of the turbine. This ring may be substantially continuous, with small gaps occurring at the boundary between the abutting rotor blades 126. The cutter tooth 160, as shown, may extend a farther distance across the trench cavity 150 than the tooth ridge 164. In addition, the cutter tooth 160 may be formed integrally to the turbine rotor blade 126 or, in some cases, may be attached thereto via conventional methods.

As shown, in some embodiments, the honeycomb 162 may be formed on the leading edge of the stator blade 128. More particularly, the honeycomb 162 may be formed on the leading edge of the inner sidewall 142. The honeycomb 162 may comprise any conventional suitable abradable material, such as, Hast-X or other similar material, and may be attached to the stator blade 128 via conventional methods. The honeycomb 162 may be rectangular in shape, as depicted in FIG. 5, and positioned such that the approximate center of the rectangular shape is radially aligned with the radial position of the edge of the cutter tooth 160. Other shapes are also possible. The honeycomb 162 may extend circumferentially along the approximate entire width of each inner sidewall 142 such that the honeycomb 162 forms an approximate circle around the row of stator blades 128, with the center of the circle being substantially aligned with the shaft of the turbine. This ring may be substantially continuous, with small gaps occurring at the boundary between the abutting stator blades 128.

In a preferred embodiment, as shown, the cutter tooth 160/honeycomb 162 assembly is configured such that the cutter tooth 160 is positioned on the radially outward, trailing edge portion of the shank 136 of the rotor blade 126, and the honeycomb 162 is positioned on the leading edge of the inner sidewall 142 of the stator blade 128. Alternatively, not shown, the cutter tooth 160/honeycomb 162 assembly may also be configured such that the cutter tooth 160 is positioned on the leading edge portion of the shank 136 of the rotor blade 126, and the honeycomb 162 may be positioned on the trailing edge of the inner sidewall 142 (or, in some cases, the diaphragm 144) of the stator blade 128.

Further, in the preferred embodiment of FIG. 5, the cutter tooth 160 may be positioned on the shank such that it is outboard of the angel wing 152. In this case, the honeycomb 162 may be positioned such that it is outboard of the stator projection 154. Alternatively, not shown, the cutter tooth 160 may be positioned on the shank such that it is inboard of the angel wing 152. In this case, the honeycomb 162 may be positioned such that it is inboard of the stator projection 152. In addition, in some applications, the multiple pairs of cutter tooth 160/honeycomb 162 assemblies may be used within a single trench cavity 150. This may enhance sealing properties.

The axial length that the cutter tooth 160 and/or the honeycomb 162 extend across the trench cavity 150 may be configured in various ways depending on the results desired. For example, in some embodiments, the axial length of each may be configured such that, when the trench cavity 150 opening is generally most narrow, the outer edge of the cutter tooth 160 resides in an axial position that is substantially adjacent to the outer face of the honeycomb 162. In other embodiments, the axial length of the cutter tooth 160 and/or the honeycomb 162 may be configured such that, when the trench cavity 150 opening is generally most narrow, the outer edge of the cutter tooth 160 resides in a position that overlaps or cuts into the outer face of the honeycomb 162.

In embodiments in which the cutter tooth 160 is coupled with a tooth ridge 164 (as described above), the axial length of the cutter tooth 160, the tooth ridge 164, and/or the honeycomb 162 may be configured such that, when the trench cavity 150 opening is generally most narrow, the outer edge of the cutter tooth 160 resides in a radial position that overlaps or cuts into the outer face of the honeycomb 162, and the outer edge of the tooth ridge 164 resides in a radial position that is substantially adjacent to the outer surface of the honeycomb 162.

In a preferred embodiment, as shown in FIG. 5, the cutter tooth 160 is formed on the rotor blade 126 and the honeycomb 162 is formed on the stator blade 128. In other embodiments, the cutter tooth 160 may be formed on the stator blade 128 and the honeycomb 162 formed on the rotor blade 126.

In operation, the cutter tooth 160/honeycomb 162 assembly may be configured such that, during operation, the assembly narrows the width of the opening (i.e., the axial gap) of the trench cavity 150. That is, the cutter tooth 160/honeycomb 162 assembly may form an axial extending seal around the circumference of the trench cavity 150 opening. Note that, as previously stated, the cutter tooth 160/honeycomb 162 may be located inboard of the trench cavity 150 opening. In some embodiments, the cutter tooth 160/honeycomb 162 assembly may be configured such that they come in contact with each other during certain operating conditions. Particularly, during one of the operating conditions in which the trench cavity 150 opening is relatively narrow, the cutter tooth 160/honeycomb 162 assembly may be configured such that the cutter tooth 160 makes contact with/rubs against the honeycomb 162. This contact, while very undesirable if it included one hard surface against another, allows the rigid/sharp cutting tooth 160 to carve a channel through the abradable material of the honeycomb 162. Once the channel is formed, the cutter tooth 160 may reside in the channel during certain operating conditions and, thereby, provides an effective seal against ingestion of working fluid into the wheelspace cavity 156. Even when a change in operating conditions widens the trench cavity 150, the cutter tooth 160 may still reside within the channel (though not as deeply) and provide an effected seal against ingestion. And, when another change in operating conditions further widens the trench cavity such that the cutter tooth 160 no longer resides in the cut channel, the cutter tooth 160/honeycomb 162 assembly still narrows the width of the trench cavity 150 and prevent some working fluid ingestion. With these increased sealing characteristics at the trench cavity 150, as one of ordinary skill in the art will appreciate, the amount of purge air needed to prevent ingestion likely will be significantly reduced. As discussed, this reduction allows for improved engine performance and efficiency.

Figure 6:
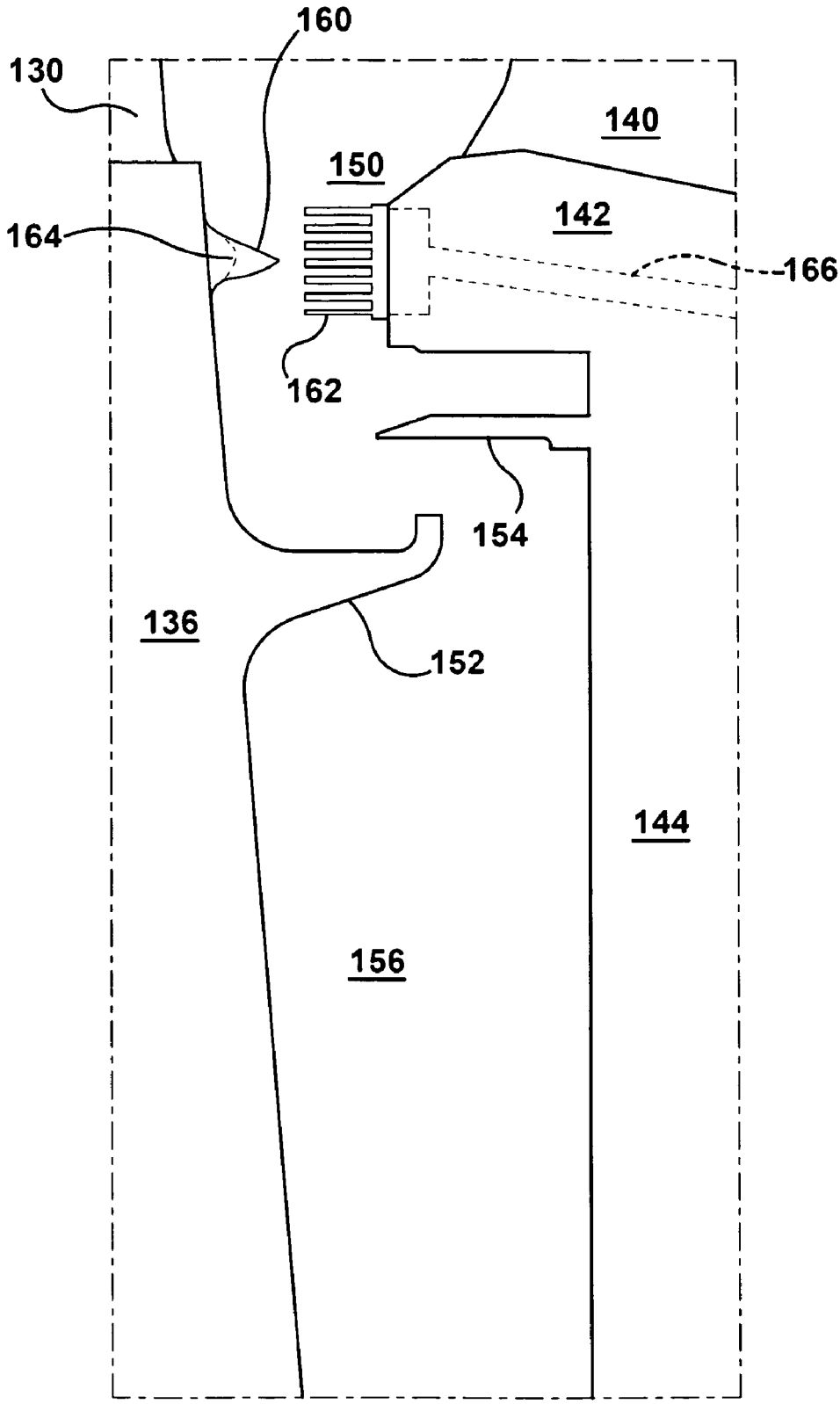
FIG. 6 is a sectional view of a trench cavity and a cutter tooth/honeycomb assembly according to an alternative embodiment of the present invention.

In an alternative embodiment, as shown in FIG. 6, cooling air may be provided through the stator blade 128 to the location of the honeycomb 162 through a cooling air channel 166. As one of ordinary skill in the art will appreciate, the abradable honeycomb 162 may be porous. As such, providing a feed of cooling air (per conventional methods) to the attached face of the honeycomb 162 results in a stream of air passing through the honeycomb 162 and generally exiting the honeycomb 162 through the outer face that faces the cutter tooth 160. Provided in this manner, the cooling air may have at least two operational benefits.

First, the cooling air cools the honeycomb 162 and any materials, such as, adhesives, brazing or whatever, that might have been used to attach the honeycomb 162 to the inner sidewall 142. The cooling may help maintain the integrity of the joint between and honeycomb 162 and the inner sidewall 141 and also prolong the life of the honeycomb material.

Second, the cooling air may create an "air curtain" that helps prevent the ingestion of working fluid into the trench cavity 150. That is, the flow of the cooling air from the honeycomb 162 generally strikes the opposing wall and is deflected toward the hot-gas path. This outflow may deflect working fluid and prevent it from being ingested. In some embodiments, the positioning of the cutter tooth 160 and its triangular shape may be manipulated such that more of the cooling air from honeycomb 162 is deflected toward the working fluid instead of toward the wheelspace cavity 156. This may be achieved by locating the cutter tooth 160/tooth ridge 164 at the radial position that is inboard of the radial center of the honeycomb. In this position, a greater percentage of the cooling air leaving the honeycomb 162 would strike outboard of the cutter tooth 160/tooth ridge 164 and be deflected toward the working fluid. This may enhance the effectiveness of the air curtain.

As one of ordinary skill in the art will appreciate, the many varying features and configurations described above in relation to the several exemplary embodiments may be further selectively applied to form the other possible embodiments of the present invention. For the sake of brevity and taking into account the abilities of one of ordinary skill in the art, each possible iteration is not herein discussed in detail, though all combinations and possible embodiments embraced by the several claims below are intended to be part of the instant application. In addition, from the above description of several exemplary embodiments of the invention, those skilled in the art will perceive improvements, changes and modifications. Such improvements, changes and modifications within the skill of the art are also intended to be covered by the appended claims. Further, it should be apparent that the foregoing relates only to the described embodiments of the present application and that numerous changes and modifications may be made herein without departing from the spirit and scope of the application as defined by the following claims and the equivalents thereof.

We claim:

1. A seal formed between at least two blades in the turbine of a turbine engine, a first turbine blade and a second turbine blade, wherein one of the turbine blades comprises a turbine rotor blade and the other turbine blade comprises a turbine stator blade, and wherein a trench cavity and the seal are formed between the first turbine blade and the second turbine blade when first turbine blade is circumferentially aligned with the second turbine blade, the seal comprising:

a cutter tooth and a honeycomb;

wherein:

the cutter tooth comprises an axially extending rigid tooth positioned on one of the first turbine blade and the second turbine blade and the honeycomb comprises an abradable material that is positioned on the other of the first turbine blade and the second turbine blade; and the cutter tooth and the honeycomb are positioned such that each opposes the other across the trench cavity when the first turbine blade is circumferentially aligned with the second turbine blade;

further comprising a cooling air channel that is formed within the turbine blade on which the honeycomb is attached and configured to deliver a supply of cooling air to surface of the honeycomb that is attached to the blade;

wherein the honeycomb and the cooling air channel are configured such that, in operation, an air curtain is formed within the trench cavity that prevents at least some ingestion of working fluid into the trench cavity; and wherein the cutter tooth is formed to deflect the flow of cooling air from the honeycomb toward the opening of the trench cavity and into flow of working fluid.

2. The seal according to claim 1, wherein:

the turbine engine comprises at least a plurality of operating conditions;

the cutter tooth and the honeycomb are configured such that during at least one of operating conditions the cutter tooth makes contact with the honeycomb when the first turbine blade is circumferentially aligned with the second turbine blade; and the cutter tooth comprises a relatively sharp edge.

3. The seal according to claim 1, wherein:

the trench cavity comprises an axial gap that extends circumferentially between the rotating parts and the stationary parts of the turbine; and the cutter tooth and the honeycomb are configured to reduce the axial width of the trench cavity.

4. The seal according to claim 1, wherein:

the cutter tooth is formed on one of the turbine stator blade and the turbine rotor blade and the honeycomb is formed on the other of the turbine stator blade and the turbine rotor blade; and the trench cavity is formed between at least one of the trailing edge of the rotor blade and the leading edge of the stator blade, and the trailing edge of the stator blade and the leading edge of the rotor blade.

5. The seal according to claim 1, wherein the honeycomb comprises a rectangular shape and is positioned such that the approximate center of the rectangular shape is radially aligned with the cutter tooth.

6. The seal according to claim 1, wherein the outer edge of the cutter tooth is positioned at a radial position that is inboard of the radial center of the honeycomb such that, in operation, a greater percentage of the cooling air leaving the honeycomb strikes outboard of the cutter tooth and is thereby deflected toward the opening of the trench cavity and into the flow of working fluid.

7. The seal according to claim 1, wherein:

the turbine engine comprises at least a plurality of operating conditions; and the axial width of the trench cavity varies depending upon the operating condition under which the turbine engine operates such that the trench cavity comprises a relatively narrow opening during at least one of the operating conditions and a relatively wide opening during at least one of the other operating conditions.

8. The seal according to claim 7, wherein the axial length of the cutter tooth and the honeycomb are configured such that, when the trench cavity is most narrow, the outer edge of the cutter tooth is substantially adjacent to the outer face of the honeycomb.

9. The seal according to claim 7, wherein the axial length of the cutter tooth and the honeycomb is configured such that, when the trench cavity is most narrow, the outer edge of the cutter tooth cuts into the outer face of the honeycomb.

10. The seal according to claim 1, wherein:

the turbine rotor blade includes an airfoil that resides in the hot-gas path of and interacts with the working fluid of the turbine, means for attaching the turbine rotor blade to a rotor wheel, and, between the airfoil and the means for attaching, a shank; and the turbine stator blade includes an airfoil that resides in the hot-gas path of and interacts with the working fluid of the turbine and, radially inward of the airfoil, an inner sidewall that forms the inner boundary of the path of the working fluid and, radially inward of the inner sidewall, a diaphragm that forms a second seal with one or more rotating components.

11. The seal according to claim 10, wherein the cutter tooth resides on the trailing edge of the rotor blade and the honeycomb resides on the leading edge of the stator blade.

12. The seal according to claim 10, wherein:

the longitudinal axis of the cutter tooth is aligned circumferentially and extends along a portion of the circumferential width of the shank; and the cutter tooth portion is less than the total circumferential width of the shank;

further comprising a tooth ridge that extends over the approximate remainder of the circumferential width of the shank and extends along substantially the same longitudinal axis of the cutter tooth, wherein the tooth ridge comprises a protruding ridge that extends axially a distance that is less than the distance that the cutter tooth extends axially.

13. The seal according to claim 12, wherein, collectively, the cutter tooth and the tooth ridge extend along substantially the entire circumferential width of the shank.

14. The seal according to claim 10, wherein the cutter tooth is positioned on the radially outward, trailing edge portion of the shank of the rotor blade and the honeycomb is positioned on the leading edge of the inner sidewall of the stator blade.

15. The seal according to claim 14, wherein:

the turbine engine comprises at least a plurality of operating conditions;

the axial width of the trench cavity varies depending upon the operating condition under which the turbine engine operates such that the trench cavity comprises a relatively narrow opening during at least one of the operating conditions and a relatively wide opening during at least one of the other operating conditions;

the axial length of the cutter tooth, the tooth ridge, and the honeycomb are configured such that, when the trench cavity is generally most narrow, the outer edge of the cutter tooth cuts into the outer face of the honeycomb, and the outer edge of the tooth ridge is substantially adjacent to the outer surface of the honeycomb.

16. The seal according to claim 10, wherein one edge of the trench cavity is formed by the shank and the other edge of the trench cavity is formed by one or both of the inner sidewall and the diaphragm.

17. The seal according to claim 16, wherein the cutter tooth resides on the trailing edge of the shank and the honeycomb resides on the leading edge of the inner sidewall.

18. The seal according to claim 16, wherein the trench cavity comprises at least one angel wing formed on the shank and at least one a stator projection formed on one of the inner sidewall and the diaphragm, and each angel wing is formed inboard of the at least one stator projection.

19. The seal according to claim 18, wherein the cutter tooth is positioned on the shank such that it is outboard of the angel wing and the honeycomb is positioned such that it is outboard of the stator projection.

* * * * *